US006188863B1

(12) United States Patent
Gross et al.

(10) Patent No.: US 6,188,863 B1
(45) Date of Patent: Feb. 13, 2001

(54) METHOD AND APPARATUS FOR CLEANING A TRANSFER ASSIST APPARATUS

(75) Inventors: Robert A. Gross, Penfield; Douglas W. Sass, Ontario, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/359,385

(22) Filed: Jul. 23, 1999

(51) Int. Cl.[7] ..... G03G 15/16
(52) U.S. Cl. ..... 399/316; 399/66; 399/101
(58) Field of Search ..... 399/66, 98, 99, 399/101, 297, 316, 317, 345

(56) References Cited

U.S. PATENT DOCUMENTS 4,101,212 * 7/1978 Sumiyoshi et al. ..... 399/316
4,931,839 * 6/1990 Tompkins et al. ..... 399/66
4,947,214 8/1990 Baxendell et al. .
5,227,852 7/1993 Smith et al. .
5,247,335 9/1993 Smith et al. .
5,268,723 * 12/1993 Kikuchi ..... 399/101
5,300,993 4/1994 Vetromile .
5,300,994 4/1994 Gross et al. .
5,539,508 7/1996 Piotrowski et al. .
5,568,238 10/1996 Osbourne et al. .
5,613,179 3/1997 Carter et al. ..... 399/316
5,720,094 2/1998 Carter et al. ..... 29/446
5,923,921 * 7/1999 OuYang et al. ..... 399/66

* cited by examiner

*Primary Examiner*—Sandra Brase

(57) ABSTRACT

An apparatus and method for transferring an image from an imaging surface to a sheet. The apparatus includes a transfer assist blade having a contact surface which is moved from a nonoperative position spaced from the sheet, to an operative position, in contact with the sheet for pressing the sheet into contact with the image. The transfer assist apparatus includes a cleaning member for cleaning the contact surface as it moves between the operative and nonoperative positions.

8 Claims, 3 Drawing Sheets

METHOD AND APPARATUS FOR CLEANING A TRANSFER ASSIST APPARATUS

The present invention relates generally to an electrostatographic printing machine, and, more specifically, concerns an apparatus for assisting the transfer of a toned image from an imaged surface to a copy sheet with the assistance of electrostatic charges.

In a typical electrostatographic copying or printing process using electrophotography, a photoconductive member is charged to a substantially uniform potential and the charged portion of the photoconductive member is subsequently exposed to a light image of a document being reproduced or printed. Exposure of the charged photoconductive member selectively dissipates the charge thereon in the irradiated areas so as to record on the photoconductive member an electrostatic latent image corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image to form a toner powder image on the photoconductive member. The toner powder image is then transferred from the surface of the photoconductive member to a copy substrate such as a sheet of paper. Thereafter, heat or some other treatment is applied to the toner particles to permanently affix the powder image to the copy substrate.

The electrophotographic printing process described above is well known and is commonly used for light lens copying of an original document and for electrostatographic printing such as, for example, digital printing where the latent image is produced by a modulated laser beam, or ionographic printing and reproduction, where charge is selectively deposited on a charge retentive surface in response to an electronically generated or stored image.

The process of transferring charged toner particles from an image bearing member such as the photoconductive member to an image support substrate such as the copy sheet is enabled by overcoming adhesive forces holding the toner particles to the image bearing member. Typically, transfer of developed toner images in electrostatographic applications is accomplished via electrostatic induction using a corona generating device, wherein the image support substrate is placed in direct contact with the developed toner image on the photoconductive surface while the reverse side of the image support substrate is exposed to a corona discharge for generating ions having a polarity opposite that of the toner particles, to electrostatically attract the toner particles from the photoreceptive member and transfer the toner particles to the image support substrate. An exemplary ion emission corotron transfer system is disclosed in U.S. Pat. No. 2,836,725.

As described, the typical process of transferring development materials in an electrostatographic system involves the physical detachment of charged toner particles from a selectively charged image bearing surface and transfer-over to an image support substrate via electrostatic force fields. A critical aspect of the transfer process involves the application and maintenance of high intensity electrostatic fields in the transfer region for overcoming the adhesive forces acting on the toner particles as they rest on the surface of the selectively charged imaging member. In addition, other forces, such as mechanical pressure or vibratory energy, have been used to support and enhance the transfer process. Careful control of electrostatic fields and other forces is essential for inducing the physical detachment and transfer-over of the charged toner particles without scattering or smearing of the developer material which may result in an unsatisfactory output image.

In addition to careful control of electrostatic fields and other forces when electrostatically transferring a toner powder image to a copy sheet, it is generally necessary for the copy sheet to be in intimate contact with the toner particles on the selectively charged imaging surface. However, the interface between the selectively charged imaging surface and the copy substrate is rarely uniform. In particular, non-flat or uneven image support substrates, such as copy sheets that have been mishandled, paper that has been left exposed to the environment, or substrates that have previously passed through a fixing operation (e.g., heat and/or pressure fusing) often tend to yield imperfect contact with the photoconductive surface. Some printing applications require imaging onto high quality papers having surface textures which prevent intimate contact of the paper with the developed toner images. In duplex printing systems, even initially flat paper can become cockled or wrinkled as a result of paper transport and/or the first side fusing step. Also, color images can contain areas in which intimate contact of toner with paper during the transfer step is prevented due to adjacent areas of high toner pile heights. The lack of uniform intimate contact between the belt and the copy sheet in these situations can result in spaces or air gaps between the developed toner powder image on the selectively charged imaging surface and the copy sheet. When spaces or gaps exist between the developed image and the copy substrate, various problems may result. For example, there is a tendency for toner not to transfer across gaps, causing variable transfer efficiency and, under extreme circumstances, creating areas of low toner transfer or even no transfer, resulting in a phenomenon known as image transfer deletion. Clearly, image transfer deletions are very undesirable in that useful and necessary information and indicia may not be reproduced on the copy sheet.

Transfer deletion has been addressed through various approaches. The following disclosures may be relevant:

- U.S. Pat. No. 4,947,214 Patentee: Baxendell, et al. Issued: Aug. 7, 1990
- U.S. Pat. No. 5,227,852 Patentee: R. Smith et al. Issued: Jul. 13, 1993
- U.S. Pat. No. 5,247,335 Patentee: R. Smith et al. Issued: Sep. 21, 1993
- U.S. Pat. No. 5,300,993 Patentee: Vetromile Issued: Apr. 5, 1994
- U.S. Pat. No. 5,300,994 Patentee: Gross et al. Issued: Apr. 5, 1994
- U.S. Pat. No. 5,539,508 Patentee: Piotrowski et al. Issued: Jul. 23, 1996
- U.S. Pat. No. 5,568,238 Patentee: Osbourne et al. Issued: Oct. 22, 1996
- U.S. Pat. No. 5,613,179 Patentee: Carter et al. Issued: Mar. 18,1997
- U.S. Pat. No. 5,720,094 Patentee: Carter et al. Issued: Feb. 24, 1998

The foregoing disclosures may be briefly summarized as follows: U.S. Pat. No. 4,947,214, U.S. Pat. No. 5,227,852, U.S. Pat. No. 5,300,393, U.S. Pat. No. 5,300,994, U.S. Pat. No. 5,539,508 and U.S. Pat. No. 5,568,238 disclose a system for transferring a developed image from a photoconductive surface to a copy sheet, including a corona generating device and a transfer assist blade. The blade is moved from a nonoperative position spaced from the copy sheet, to an operative position, in contact with the copy sheet for pressing the copy sheet into contact with the developed image on the photoconductive surface to substantially eliminate any spaces therebetween during the transfer process.

U.S. Pat. No. 5,247,335 discloses a transfer blade for ironing a sheet against a photoreceptor belt during transfer, thereby smoothing out deformities that cause deletions. The transfer blade includes a flexible tip to absorb the impact of the blade as it contacts the paper and a spring load to limit and control the force applied to the sheet.

The entire disclosures of the above-referenced patents are hereby incorporated by reference for their relevant teachings.

As taught in the prior art, no portion of the transfer assist blade should contact the imaging surface since such contact will result, in most instances, in the pick up of residual dirt and toner from the imaging surface onto the portion of the transfer assist blade that contacts the imaging surface. In order to ensure that a transfer assist blade contacts the copy sheet only within the copy sheet perimeter, either the transfer assist blade must be shortened to correspond to the narrowest copy sheet width expected to be processed in the printer or there must be added an apparatus for detecting the width of each copy sheet and varying the effective length of the transfer assist blade to correspond to the width of such sheet. Apparatus such as those disclosed in U.S. Pat. No. 5,300,994 and U.S. Pat. No. 5,539,508 are capable of varying the effective length of the transfer assist blade when operating in conjunction with appropriate sensors and algorithms. The complexity of such systems increases the cost of the printing device.

In accordance with the present invention, there is provided an apparatus for providing substantially uniform contact between a sheet and an image on an imaging surface. The apparatus comprises a transfer assist blade which includes a contact surface adapted to be moved between a nonoperative position spaced from the imaging surface to an operative position in contact with the sheet on the image, for pressing the copy sheet thereagainst, and further comprises a cleaning member operatively associated with the contact surface to clean the contact surface during movement thereof between the operative and the nonoperative positions.

Pursuant to another aspect of the present invention, there is provided a printing machine including a transfer station for transferring an image from a moving imaging member to a copy substrate, including an apparatus for providing substantially uniform contact between the copy substrate and the image located on the imaging member, comprising a transfer assist blade, including a contact surface, such contact surface being adapted to be moved between a nonoperative position spaced from the image to an operative position in contact with the substrate on the image, for pressing the copy substrate thereagainst, and a cleaning member operatively associated with the contact surface to clean the contact surface during movement thereof between the operative and nonoperative positions.

Pursuant to another aspect of the invention, there is provided a method for providing substantially uniform intimate contact between a moving copy substrate having leading and trailing edges and an image located on an imaging member, such method comprising the steps of (1) moving a contact surface of a transfer assist blade between an nonoperative position spaced from the imaging surface and an operative position in contact with the copy sheet on the image, and (2) cleaning the contact surface as it moves between its operative and nonoperative positions.

Other aspects of the present invention will become apparent as the following description proceeds and upon reference to the drawings, in which.

While the present invention will hereinafter be described in connection with its preferred embodiments and method of use, it will be understood that it is not intended to limit the invention to these embodiments and method of use. On the contrary, the following description is intended to cover all alternatives, modifications, and equivalents, as may be included within the spirit and scope of the invention as defined by the appended claims.

In as much as the art of electrophotographic printing is well known, the various process stations employed in the FIG. 5 printing machine will be shown hereinafter schematically and their operation described briefly with reference thereto.

Figure 4:
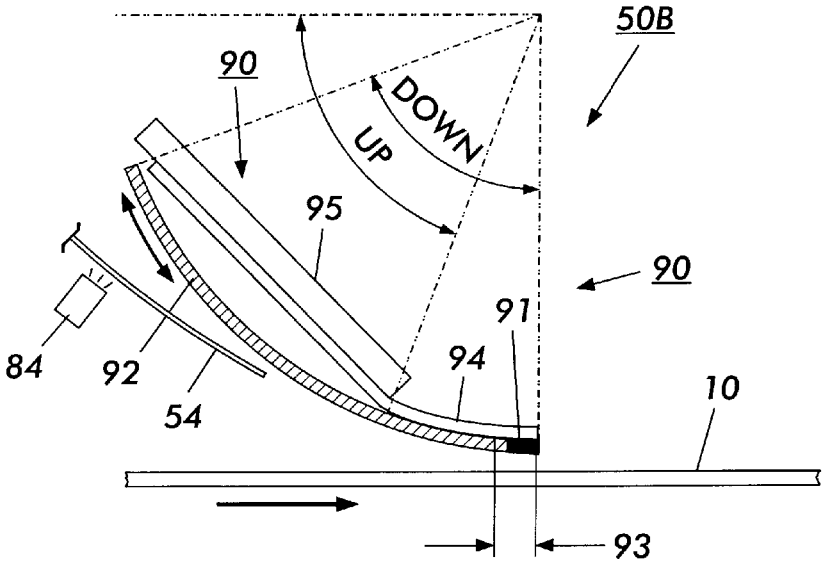
FIG. 4 is a sectional elevational view showing the FIG. 3 contact surface in the non-operative position.
Figure 5:
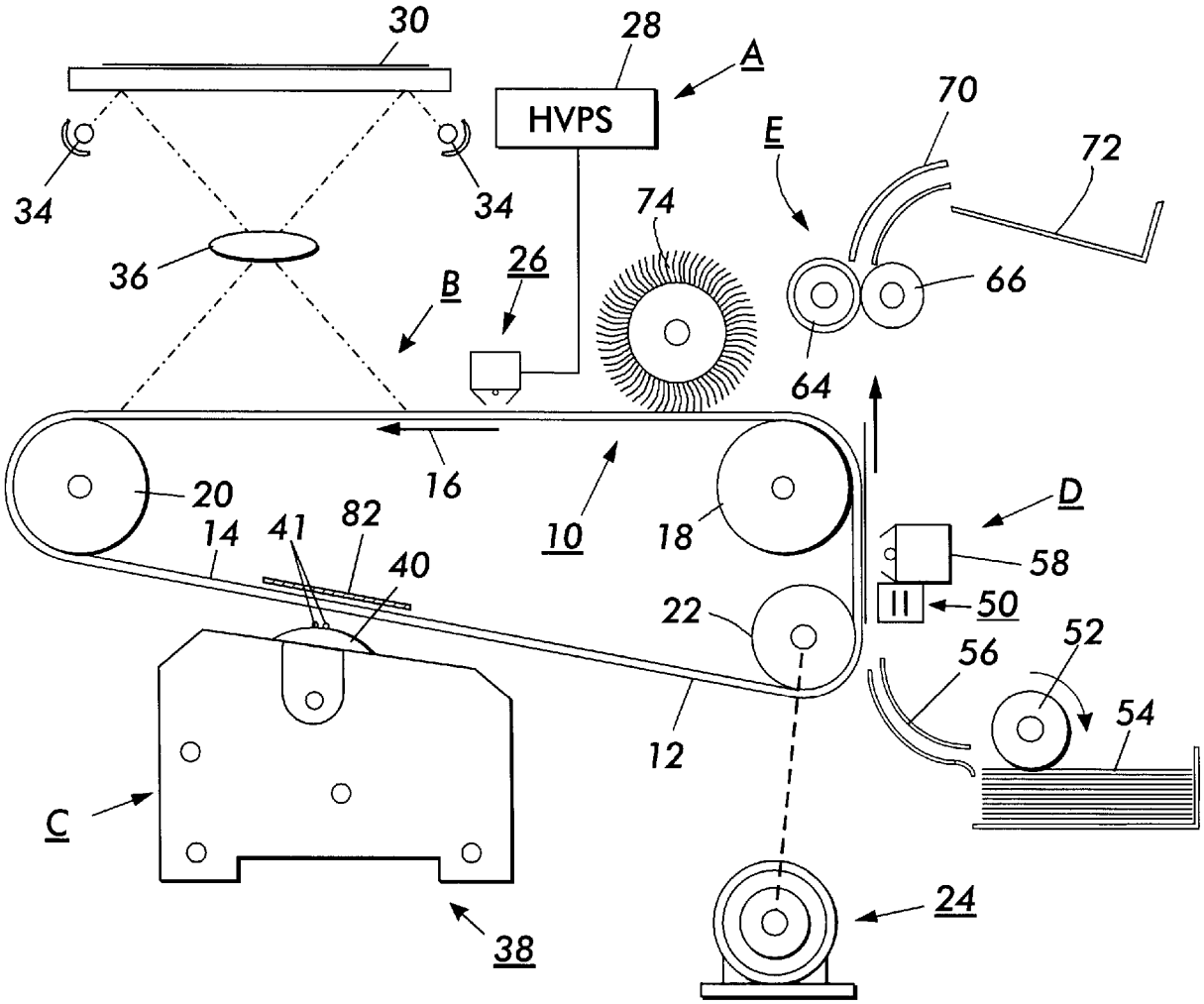
FIG. 5 is a schematic elevational view of an exemplary electrophotographic printing machine incorporating the transfer assist apparatus of the present invention therein.

Referring initially to FIG. 5, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B. At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30. After the electrostatic latent image has been recorded on photoconductive surface 12, belt 10 advances the latent image to development station C. At development station C, a development system, develops the latent image recorded on the photoconductive surface. Preferably, development system includes a donor roller 40 and electrode wires positioned in the gap between the donor roll and photoconductive belt. Electrode wires 41 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 38. The chamber in developer housing 38 stores a supply of developer material. The developer material is a two component developer material of at least magnetic carrier granules having toner particles adhering triboelectrically thereto. A transport roller disposed interiorly of the chamber of housing 38 conveys the developer material to the donor roller. The transport roller is electrically biased relative to the donor roller so that the toner particles are attracted from the transport roller to the donor roller. After the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. Contact between the copy sheet 54 and belt 10 is enhanced by transfer assist apparatus 50. Transfer assist apparatus 50 will be discussed hereinafter in greater detail with reference to FIGS. 1, 2, 3, and 4. As the belt 10 turns around roller 18, the copy sheet 54 is stripped therefrom with the toner image thereon. After transfer, the copy sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator. After the sheet is separated from photoconductive surface 12 of belt 10, the residual toner particles adhering to photoconductive surface 12 are removed therefrom by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the transfer assist apparatus of the present invention therein. Although the apparatus of the present invention is particularly well adapted for use in an electrophotographic reproducing machine as shown in FIG. 5, it will become apparent from the following discussion that the transfer assist apparatus of the present invention is equally well suited for use in a wide variety of electrostatographic processing machines as well as many other known printing systems.

Figure 1:
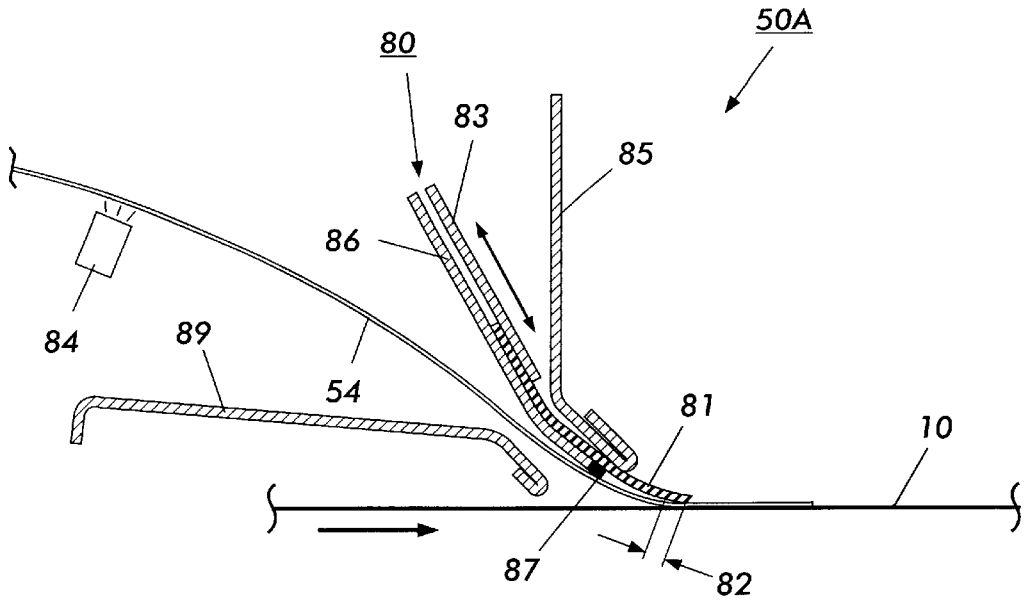
FIG. 1 is a sectional elevational view of one embodiment of the present invention showing the contact surface in the operative position.
Figure 2:
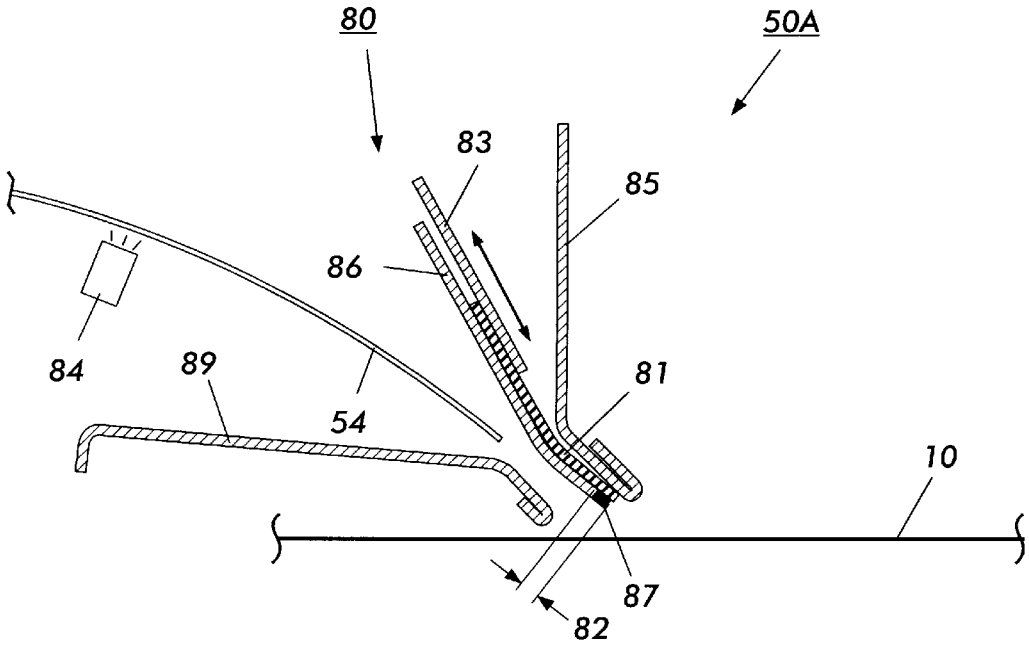
FIG. 2 is a sectional elevational view showing the FIG. 1 contact surface in the non-operative position.

Moving now to the particular features of the transfer assist apparatus of the present invention, reference is made to FIGS. 1 and 2, wherein a transfer assist apparatus 50A is depicted in its operative position in FIG. 1 and its nonoperative position in FIG. 2 in an enlarged sectional elevational view. It will be understood that corona generator 58 has been deleted from this figure for purposes of clarity.

The transfer assist apparatus 50A includes a transfer assist blade assembly 80 comprised of a flexible blade member 81, a portion of which forms a contact surface 82 in intimate contact with the back side of the copy sheet 54. Flexible blade member 81 is fixedly mounted onto or in a rigid support member 83 made of a stiff plastic or extruded metal such as aluminum. The flexible blade member 81 itself is fabricated from a resilient, flexible material, as for example, Mylar®, manufactured by E.I. DuPont de Nemours, Co. of Wilmington, Del. The rigid support member 83 is mounted to an actuating mechanism (not shown) for providing selective oscillating positioning of the transfer assist blade assembly 80 relative to the imaging surface of belt 10. Suitable actuating mechanisms for such positioning are well known in the art. One example of such a mechanism is a spring-biased, slidable mounting in which the spring biasing force is overcome by an actuated solenoid mechanism. Another example includes mounting of the transfer blade assembly 80 onto a rotatable shaft driven by a cam/stepper motor actuating system.

In the illustrated embodiment shown in FIG. 1, the operative position of transfer assist blade assembly 80 is defined by contact between the contact surface 82 of the transfer assist blade 81 and a copy sheet 54, thereby pressing the copy sheet into the toner powder image developed on the imaging surface of belt 10.

FIG. 2 illustrates the same embodiment as FIG. 1 wherein the transfer assist blade assembly 80 is in its nonoperative position defined by the contact surface 82 being spaced from the copy sheet 54 and the imaging belt 10 such that no contact engagement exists therebetween. It will be understood that shifting between the operative and nonoperative positions is occasioned by the presence or absence of a copy sheet 54 in the transfer station D region such that some known apparatus for identifying the location of the leading and the trailing edge of the copy sheet is incorporated into the transfer assist apparatus of the present invention. FIGS. 1 and 2 show, for example, a light sensor 84 for detecting the leading edge of the copy sheet as it enters the transfer station D or as the copy sheet travels through an area of the machine prior to delivery to the transfer station. The signal from the light sensor 84 is processed by a circuit for controlling the actuation of the transfer assist assembly 80 such that the contact surface 82 of the transfer assist blade 81 is moved from a nonoperative position, spaced from the photoconductive belt 10 as in FIG. 2 to an operative position as shown in FIG. 1 wherein the contact surface 82 presses the back side of the copy sheet 54 toward the imaging belt 10. Exemplary of light sensors and delay circuits suitable for use with the described transfer assist apparatus are known, as for example that described in U.S. Pat. No. 4,341,456 issued to Lyer et al. in 1982, the relevant portions thereof being hereby incorporated into the present application.

In accordance with a specific feature of the embodiment disclosed in FIGS. 1 and 2, the transfer assist apparatus 50A includes a substantially fixed member 85 positioned on the side of the transfer assist blade assembly 80 opposite the imaging belt 10. This substantially fixed member 85 serves to support and guide the flexible transfer assist blade 81 by deflecting the contact surface 82 of the blade toward the imaging surface 10 at the desired angle as the blade assembly 80 moves from its nonoperative position to its operative positions.

Also in accordance with a specific feature of the embodiment disclosed in FIGS. 1 and 2, the transfer assist apparatus 50A includes a substantially fixed member 86 positioned between the transfer assist blade assembly 80 and the imaging surface 10. This second substantially fixed member 86 has a cleaning apparatus 87 such as, preferably, a cleaning blade edge, positioned to engage the contact surface 82 of the transfer assist blade 81 as such blade moves between its operative and nonoperative positions. Those skilled in the art will recognize that cleaning apparatus 87 may comprise any number of cleaning assemblies, including blades, fixed brushes, rotating brushes, wiper pads, electrostatic or vacuum cleaning elements, and similar apparatus suitable for cleaning a transfer assist blade 81 along its longitudinal axis. Whichever cleaning apparatus is chosen, the cleaning operation typically results in depositing the cleaned residual harmlessly into the space between the trailing edge of one copy sheet and the leading edge of the next copy sheet.

Another specific feature of the embodiment shown in FIGS. 1 and 2 is that the second substantially fixed member 86 has an inner surface closest to the imaging surface 10 that is used in cooperation with a lower paper guide 89 to serve as an upper paper guide as copy sheet 54 enters and moves through transfer station D. Movement of copy sheet 54 through transfer station D can be identified by the light sensor 84 described above. Specifically, in a manner similar to identification of the leading edge of copy sheet 54 in order to actuate transfer assist assembly 80 to move from its nonoperative to its operative position, the same sensor 84 can be used to identify the location of the trailing edge of copy sheet 54. A signal from such sensor 84 to a processing circuit may be used to actuate the mechanism for shifting the transfer assist blade assembly 80 back to its nonoperative position as shown in FIG. 2. As discussed above, such movement between the operative and nonoperative positions results in cleaning of the contact surface 82 by cleaning means 87. Once the transfer assist blade assembly 80 completes its shift into the nonoperative position, such assembly is spaced from the copy sheet 54 and the imaging belt 10, insuring that the transfer assist blade assembly does not increase the risk of scratching the imaging belt through unnecessary contact.

An advantageous feature enabled by the present invention as disclosed in the embodiment shown in FIGS. 1 and 2 is that portions of contact surface 82 can directly contact imaging surface 10 since excess toner and residual dirt that may be picked up during such contact will be cleaned and removed from contact surface 82 by cleaning member 87 between processing of each sheet 54. The transfer assist blade can therefore be a fixed length corresponding to the full width of the widest copy sheet 54 expected to be processed in the printer rather than to the width of the narrowest sheet expected to be processed or to a length that is adjusted for various widths of copy sheets 54. Thus, for some sheets the contact surface 82 will extend beyond sheet 54.

Figure 3:
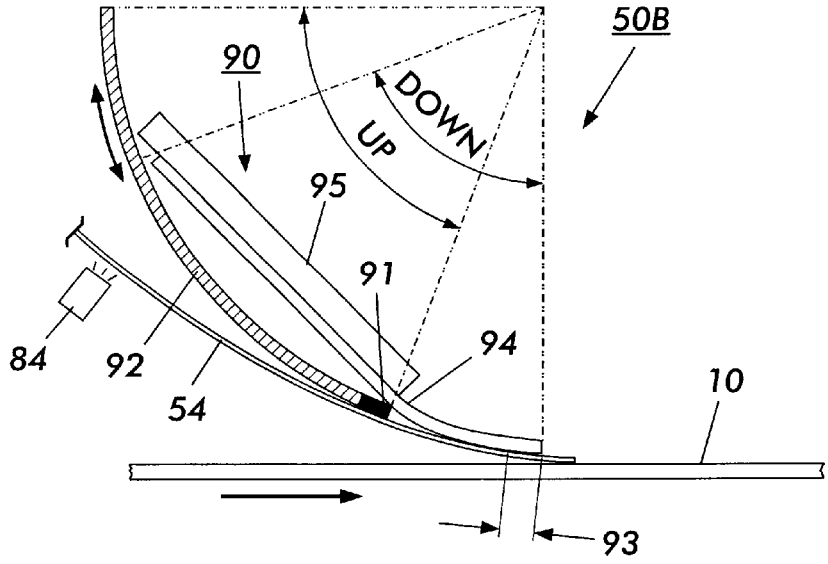
FIG. 3 is a sectional elevational view of another embodiment of the present invention showing the contact surface in the operative position.

In accordance with the specific features of a second embodiment disclosed in FIGS. 3 and 4, the transfer assist apparatus 50B includes a substantially fixedly mounted transfer assist blade assembly 90 comprised of a flexible blade member 94 and a rigid mounting member 95. Flexible blade member 94 has a contact surface 93 positioned to press upon the back side of copy sheet 54 when the transfer assist blade assembly 90 is in its operative position as shown in FIG. 3. A cleaning apparatus 91 is mounted on an reciprocating support member 92 such that when such cleaning apparatus 91 is moved toward the contact surface 93 as shown in FIG. 4, it pushes and deflects such contact surface 93 into a nonoperative position spaced from the copy sheet 54. As such cleaning apparatus 91 pushes against such contact surface 93, the cleaning apparatus 91 interacts with and cleans such contact surface 93 of residual material. Similarly, when such cleaning apparatus 91 is moved away from such contact surface 93, as shown in FIG. 3, pressure against such contact surface 93 is released, and contact surface 93 returns to its operative position in contact with the copy sheet 54 on the imaging surface 10. It can be understood that although the reciprocating movement in FIGS. 3 and 4 is shown by a pivotally mounted support member 92, any method of mounting such support member 92 will be effective provided that such mounting permits reciprocating motion for engaging and disengaging the contact surface 93. Similarly, although cleaning apparatus 91 preferably comprises a simple and durable blade apparatus, any number of cleaning apparatus such as fixed and rotating brushes, wiper pads, electrostatic, and vacuum cleaning apparatus could be used. Also, as described in conjunction with the embodiment shown in FIGS. 1 and 2, contact surface 93 can be a fixed length that corresponds to the process width of the widest copy sheet 54 expected to be processed in the printer rather than to the narrowest width or to an adjustable length that is adjusted for varying process widths.

Another embodiment of the present invention comprises a method for cleaning a transfer assist blade while such transfer assist blade is shifted between its operative and nonoperative positions. Such method has been described in connection with operation of the specific apparatus disclosed in FIGS. 1–4. A simplified description of such method utilizing FIGS. 1 and 2 is as follows: A copy sheet 54 is transported into a transfer station D where a sensor 84 identifies the location of the leading edge of the copy sheet 54, transmitting a signal which actuates the transfer assist blade assembly 80 to shift in the direction of the imaging surface 10. The contact surface 82 of the transfer assist blade assembly 80 is thus positioned into contact engagement with the copy sheet 54 against the belt 10 for substantially eliminating any spaces between the copy sheet and the toner powder image in order to significantly improve transfer of the toner powder image to the copy sheet. During the process of being shifted between its operative and nonoperative positions, the contact surface 82 is cleaned by a cleaning apparatus 87, thereby removing from the contact surface any residual toner and dirt that would otherwise accumulate on the contact surface 82, especially upon the portion of the contact surface which may directly contact the imaging belt 10 outside of the perimeter of the copy sheet 54. Without such removal of residual dirt and toner, the next copy sheet which is wider than the perimeter of a preceding copy sheet would be contaminated on its back side as the contaminated contact surface 82 makes contact with such wider sheet.

In review, the transfer assist apparatus of the present invention includes a transfer assist assembly, normally spaced from the imaging surface in a nonoperative position, which can be shifted to an operative position, pressing the copy sheet into intimate contact with the toner powder image developed on the imaging belt for transfer of toner therefrom. The transfer assist apparatus of the present invention also includes a cleaning apparatus positioned to clean the contact surface of the transfer assist assembly as such contact surface is shifted between its operative and nonoperative positions. When compared to transfer assist apparatus disclosed in the prior art, the present invention permits a transfer assist blade to contact the back side of various sizes of copy sheets across their entire width without requiring sensors, algorithms and complicated and costly apparatus to ensure that the blade length does not exceed the physical width of each copy sheet.

It is, therefore, evident that there has been provided, in accordance with the present invention, a transfer assist apparatus that fully satisfies the aims and advantages hereinbefore set forth. While this invention has been described in conjunction with several embodiments, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. An electrostatographic printing machine including a transfer station for transferring an image from an imaging member to a substrate comprising:

a transfer assist blade including a contact surface for contacting the back side of the substrate, the contact surface being adapted to be moved between a nonoperative position spaced from the imaging surface and an operative position in contact with the substrate on the image, for pressing the substrate thereagainst; and a cleaning member, operatively associated with the contact surface to contact and clean the contact surface during movement thereof between the operative and the nonoperative positions.

2. The electrostatographic printing machine of claim 1, wherein said cleaning member comprises:

a substantially fixedly mounted member; and a cleaning edge on said fixed member positioned to engage and clean the contact surface as the contact surface moves between the operative and nonoperative positions.

3. The electrostatographic printing machine of claim 1, wherein said contact surface extends beyond the sheet.

4. An electrostatographic printing machine including a transfer station for transferring an image from an imaging member to a sheet comprising:

a transfer assist blade including a contact surface, the contact surface being adapted to be moved between a nonoperative position spaced from the imaging surface and an operative position in contact with the sheet on the image, for pressing the sheet thereagainst; and a substantially fixedly mounted cleaning member, operatively associated with the contact surface to clean the contact surface during movement thereof between the operative and the inoperative positions and to serve as a paper guide for the copy sheet, said cleaning member further comprising a cleaning edge positioned to engage and clean the contact surface as the contact surface moves between the operative and nonoperative positions.

5. An electrostatographic printing machine including a transfer station for transferring an image from an imaging member to a sheet, comprising:

a transfer assist blade including a contact surface, the contact surface being adapted to be moved between a nonoperative position spaced from the imaging surface and an operative position in contact with the sheet on the image, for pressing the sheet thereagainst; and a cleaning member, operatively associated with the contact surface, to clean the contact surface during movement thereof between the operative and the inoperative positions, said cleaning member further comprising a cleaning brush positioned to brush against said contact surface as the contact surface moves between the operative and nonoperative positions.

6. An electrostatographic printing machine including a transfer station for transferring an image from an imaging member to a sheet, comprising:

a substantially fixedly mounted transfer assist blade includes a contact surface, the contact surface being adapted to be moved between a nonoperative position spaced from the imaging surface and an operative position in contact with the sheet on the image, for pressing the sheet thereagainst; and a cleaning member, operatively associated with the contact surface, to clean the contact surface and to move the contact surface between the operative and the inoperative positions.

7. The electrostatographic printing engine of claim 6, wherein said cleaning member reciprocates.

8. A method for providing substantially uniform contact between a sheet and an image on an imaging surface, comprising:

moving a contact surface of a transfer assist blade between an nonoperative position spaced from the imaging surface and an operative position in contact with the back side of the sheet on the image; and contacting the contact surface for cleaning as it moves between the operative and nonoperative positions.

* * * * *